US008466935B2

(12) United States Patent
Kai

(10) Patent No.: US 8,466,935 B2
(45) Date of Patent: Jun. 18, 2013

(54) GAMMA CORRECTOR WITH A STORAGE CAPACITY FOR GAMMA CORRECTION DATA REDUCED

(75) Inventor: Naoki Kai, Tokyo (JP)

(73) Assignee: Lapis Semiconductor Co., Ltd. (JP)

( * ) Notice: Subject to any disclaimer, the term of this patent is extended or adjusted under 35 U.S.C. 154(b) by 1479 days.

(21) Appl. No.: 12/057,612

(22) Filed: Mar. 28, 2008

(65) Prior Publication Data

US 2008/0238951 A1 Oct. 2, 2008

(30) Foreign Application Priority Data

Mar. 28, 2007 (JP) ..... 2007-85135

(51) Int. Cl.
*G09G 5/10* (2006.01)

(52) U.S. Cl.
USPC ..... 345/690

(58) Field of Classification Search
USPC ..... 345/87, 89, 95, 98, 101, 690–699, 345/99
See application file for complete search history.

(56) References Cited

U.S. PATENT DOCUMENTS

| | | | | |
|---|---|---|---|---|
| 6,215,468 | B1 * | 4/2001 | Van Mourik | 345/605 |
| 2005/0140597 | A1 * | 6/2005 | Lee et al. | 345/76 |
| 2006/0215047 | A1 | 9/2006 | Miyasaka | |

* cited by examiner

*Primary Examiner* — Chanh Nguyen
*Assistant Examiner* — Ram Mistry
(74) *Attorney, Agent, or Firm* — Studebaker & Brackett PC

(57) ABSTRACT

In a gamma corrector for handling gamma correction data used in performing gamma correction on image data represented by plural component colors for each of the component colors, a storage stores common data employed in common in predetermined gamma correction data in one-to-one correspondence to the plural component colors when generating final gamma-corrected image data. Another storage stores, for each component color, reproduction data represented by removing the common data from the final gamma-corrected image data of each component color in the predetermined gamma correction data. A data processor distributes input image data of each component color to both common and reproduction data to thereby generate the address data. A data coupler generates the common and reproduction data according to address data from the storages and employs the generated common and reproduction data to generate final gamma-corrected image data for image data of the component colors.

5 Claims, 13 Drawing Sheets

GAMMA CORRECTOR WITH A STORAGE CAPACITY FOR GAMMA CORRECTION DATA REDUCED

BACKGROUND OF THE INVENTION

1. Field of the Invention

The present invention relates to a gamma corrector, and more particularly to a gamma corrector for operating data of a lookup table on input image data of two or more component colors to thereby obtain gamma-corrected image data for each component color.

2. Description of the Background Art

A liquid crystal display device, as shown in FIG. 1, generally includes a backlight, two sheets of glass, two polarizer plates formed on the outer surfaces of the two glass sheets, two electrodes coated on the inner surfaces of the two glass sheets, a color filter interposed between the electrode coating and the front glass sheet, and a layer of liquid crystal molecules sandwiched between the two electrode coatings. With light illuminated from the backlight toward the front glass sheet, a voltage is applied between the front and back electrode coatings to alter the orderly arrangement of the molecules of the liquid crystal layer. This causes the transmissivity of the polarized light to vary at each pixel, whereby an image is displayed.

However, it is known that the transmissivity of light depends upon the properties of a liquid crystal and is not proportional to a potential difference applied between two electrode coatings, that is, an input voltage as shown in FIGS. 2 and 3A. For this reason, display units are required to correct a voltage-transmissivity characteristic so that it becomes a proportional characteristic easy to control. This correction will be hereinafter referred to as gamma correction. As shown in FIG. 3B, after gamma-corrected, an input voltage is applied between the electrodes. As a result, the transmissivity of light exhibits a characteristic proportional to the input voltage, as shown in FIG. 3C.

Gamma correction, as shown in FIG. 4, has heretofore been performed with a source driver used in a liquid crystal display controller. In the source driver, as shown in FIG. 4, a logic value from a timing controller controlling the liquid crystal display controller is received, this logic value is converted into an analog voltage with a digital-to-analog (D/A) converter incorporated in the source driver, and the converted voltage is applied between liquid-crystal control electrodes employed in the liquid crystal display controller. The D/A controller has a function to output an analog voltage according to characteristics of a liquid crystal and uses this function to perform a gamma correction.

However, since liquid crystal displays differ from one another in characteristics of a liquid crystal, this method has to design a gamma correction circuit specifically for an individual liquid crystal display. An example of a method for solving this problem is to provide, as shown in FIG. 5, a gamma correction function in a timing controller disposed in the stage before a source driver, not shown, and incorporate into the source driver a digital-to-analog (D/A) converter that generates an analog voltage in proportion to a logic value received from the timing controller. The D/A converter in the source driver does not have a gamma correction function. Thus, in the source driver, a logic value on which a gamma correction was performed by the timing controller is converted into an analog voltage, which is in turn applied between electrodes in a liquid crystal display.

In the above-described technique, the source driver does not need to have a gamma correction function but may be provided with only the D/A converter that generates an analog voltage proportional to a logic value. Because the timing controller performs a gamma correction, it is not necessary to make a source driver for each liquid crystal display.

Note that the gamma correction in the timing controller generally employs a writable memory such as a random access memory (RAM). The timing controller shown in FIG. 5 uses a gamma correction memory to correct an analog voltage suitable for the characteristics of a liquid crystal display so that it becomes a logic value which is generated in the source driver. The gamma correction data to be used in the correction is written into a writable memory from an external memory such as a read-only memory (ROM) when the liquid crystal display is started.

The request of high image quality to liquid crystal displays becomes stronger and stronger. For this reason, as shown in FIG. 6, a timing controller employs three gamma correction memories for the three primary colors, red, green, and blue. An increase in the number of gamma correction memories, however, enlarges a space that they occupy in the timing controller, which results in an increase in cost.

A technique for solving the above-described problem has been proposed in U.S. patent application publication No. US 2006/0215047 A1 to Miyasaka, which discloses a gamma corrector that receives a digital signal of n bits and outputs a signal of m bits. The gamma corrector includes a first, a second, and a third lookup table, a data coupler and an adder, and has a relationship in which input bits to each lookup table are fewer than n and output bits from each lookup table are fewer than m. More specifically, when signals of x bits and m1 bits are input to and output from the first lookup table, signals of n−1 bits and m2 bits are input to and output from the second lookup table, and signals of n−t bits and k bits are input to and output from the third lookup table, there is a relationship of $m \leqq m1+m2$, $x<n-t$, and $m \geqq m1+k$. The data coupler outputs a bit sequence in which a bit sequence from the first lookup table is arranged on the more significant bit side, a bit sequence from the third lookup table is arranged on the less significant bit side, and (m−m1−k) bits of "zero" are interposed between the more and less significant bit sides. The adder adds an output value from the second lookup table and a bit sequence output from the data coupler together and then outputs the added data.

However, in the technique taught by Miyasaka, divided lookup tables are employed for expressing the respective color components. Because of this, it is necessary to divide input image data and then input them to the lookup tables. After gamma correction, the final gamma-corrected image data has to be obtained by a complex method. In gamma correctors, this complex processing has become an important consideration.

SUMMARY OF THE INVENTION

It is an object of the present invention to provide a gamma corrector with a storage capacity for gamma correction data reduced without complex processing.

In accordance with the present invention, there is provided a gamma corrector for handling gamma correction data which is used in performing a gamma correction on image data represented by a plurality of component colors for each of the component colors. The gamma corrector comprises: a first storage for storing common data which is employed in common in predetermined gamma correction data in one-to-one correspondence to the plurality of component colors when generating final gamma-corrected image data; a second storage for storing, for each component color, reproduction data which is represented by removing the common data from the final gamma-corrected image data of each component color in the predetermined gamma correction data; a data processor for distributing input image data of each component color to both the common data and the reproduction data to thereby generate address data; and a data coupler for generating the common data and the reproduction data according to the address data generated by the first and second storages and for employing the generated common data and reproduction data to generate final gamma-corrected image data for image data of the plurality of component colors.

The present invention thus structured provides the advantage of reducing a storage capacity for gamma correction data without complex processing.

BRIEF DESCRIPTION OF THE DRAWINGS

The objects and features of the present invention will become more apparent from consideration of the following detailed description taken in conjunction with the accompanying drawings in which.

DESCRIPTION OF THE PREFERRED EMBODIMENTS

Figure 8:
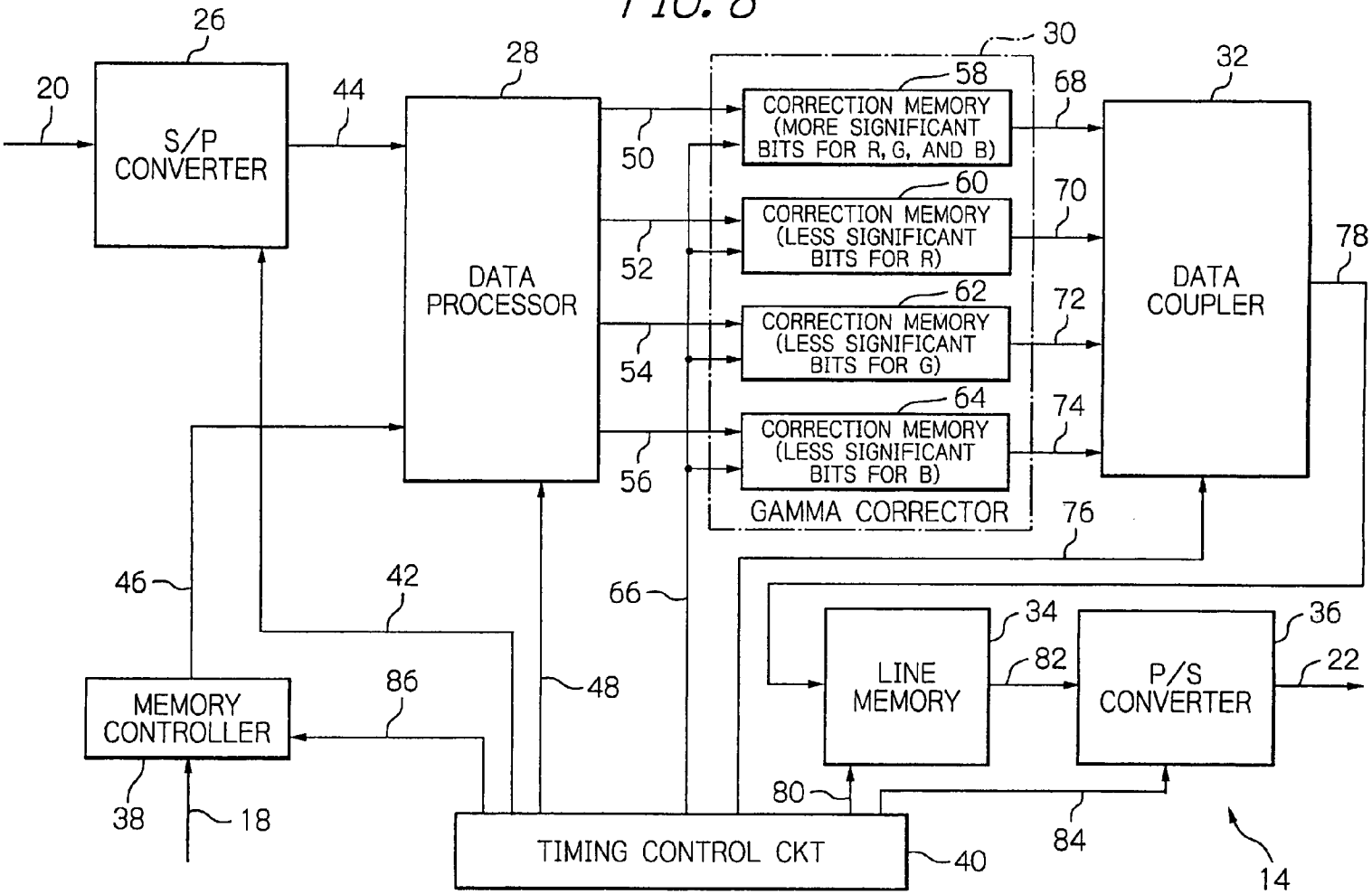
FIG. 8 is a schematic block diagram showing the timing controller shown in FIG. 7.

A preferred embodiment of a gamma corrector of the present invention will hereinafter be described in detail with reference to the accompanying drawings. Referring initially to FIG. 8, the preferred embodiment of the gamma corrector is applied to a timing controller 14 of a liquid crystal display controller 10. The timing controller 14 is constructed such that the correction memory 58 of a gamma corrector 30 stores common data which is employed in common in predetermined gamma correction data in one-to-one correspondence, i.e. respectively corresponding, to a plurality of component colors when generating final gamma-corrected image data; the memories 60, 62, and 64 of the gamma corrector 30 stores, for each component color, reproduction data which is represented by removing the common data from the final gamma-corrected image data of each component color in the predetermined gamma correction data; a data processor 28 generates address data by distributing input image data of each component color to both the common data and the reproduction data, and generates the common data and the reproduction data according to the address data from the correction memories 58, 60, 62 and 64; and a data coupler employs the generated common data and reproduction data to generate final gamma-corrected image data for image data of the plurality of component colors. With this construction, the timing controller 14 may have its storage capacity for gamma correction data reduced without complex processing.

In the illustrative embodiment, the gamma corrector is incorporated in the liquid crystal display controller 10. Parts or elements which are not directly relevant for understanding the present invention will not be shown or described.

Figure 7:
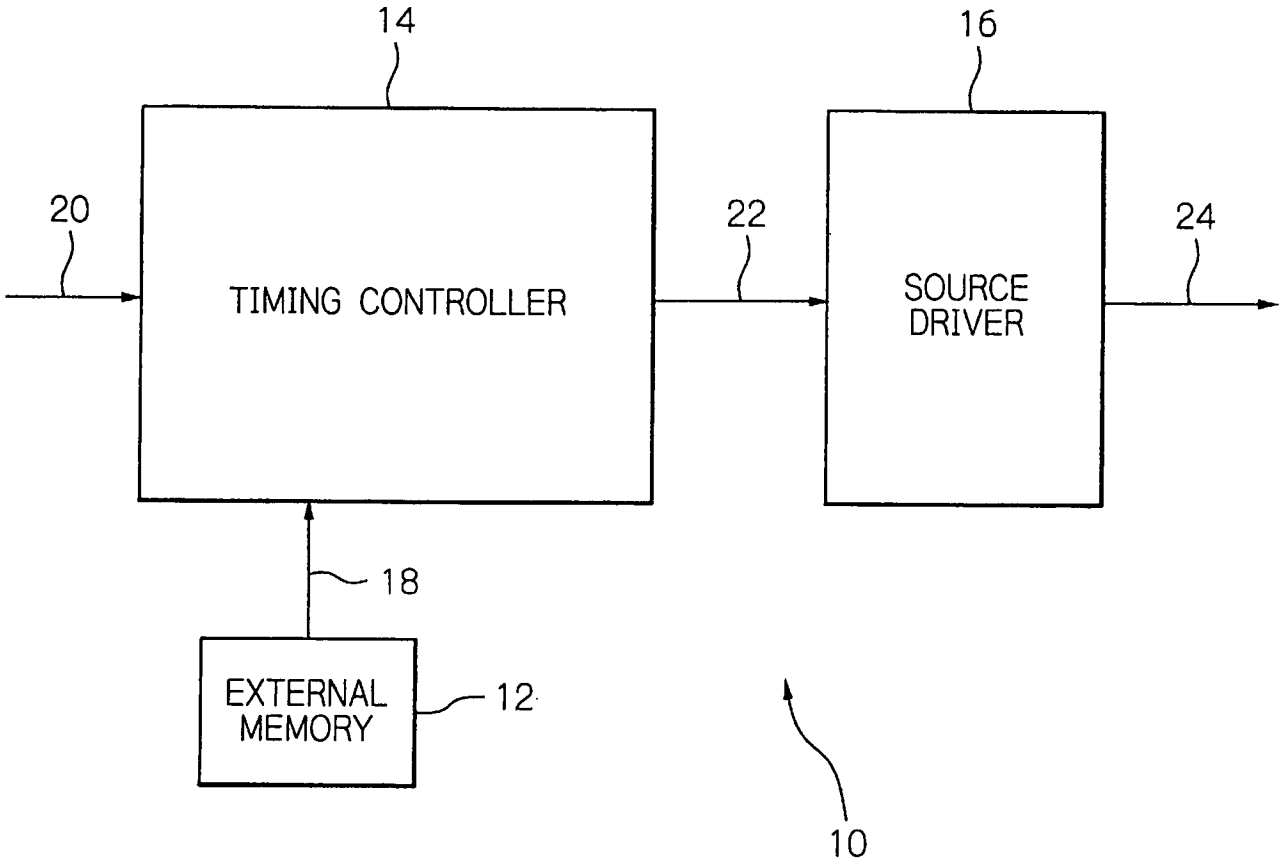
FIG. 7 is a schematic block diagram showing an embodiment of a liquid crystal display controller according to the present invention.

The liquid crystal display controller 10 is used to control the drive of a liquid crystal display panel that displays images by red (R), green (G), and blue (B) subpixels. The liquid crystal display controller 10, as shown in FIG. 7, includes an external memory 12, a timing controller 14, and a source driver 16 which are interconnected as illustrated. The liquid crystal display controller 10, as shown in the figure, is configured such that gamma correction data 18 stored in the external memory 12 is fed into the timing controller 14, and the fed gamma correction data 18 is stored in a gamma corrector of the timing controller 14. The timing controller 14 is constructed so as to receive image data 20 of the three primary colors generated by a signal processor, not shown, perform a gamma correction on the image data 20, and output the corrected image data 22 to the source driver 16. The source driver 16 is constructed so as to convert the corrected image data 22 into a corresponding analog voltage signal 24 and then output the converted analog voltage signal 24 to the liquid-crystal control electrodes of the liquid crystal panel, not shown. Signals are given the same reference numerals as connections on which they appear.

The external memory 12 is constituted by a ROM having a function to store data. Obviously, it may be constituted by an electrically erasable and programmable read-only memory (EEPROM), flash EEPROM, flexible disk, hard disk, or other memory. Data to be stored are gamma correction data which perform a gamma correction on the image data of the three primary colors generated by a signal processor, not shown. The gamma correction data are predetermined three kinds of gamma correction data respectively corresponding to the three primary colors. The external memory 12 is adapted to feed the gamma correction data 18 into the memory controller 38.

Note that the signal processor may be a graphic processor which is adapted to generate image data in which each pixel data is constituted by red (R), green (G), and blue (B) subpixels and then output the generated image data as serial data.

The timing controller 14 functions to receive image data from the signal processor, then perform a gamma correction on the received data, and perform a timing adjustment on the corrected data. The timing controller 14, as shown in FIG. 8, includes a serial-to-parallel (S/P) converter 26, a data processor 28, a gamma-corrector 30, a data coupler 32, a line memory 34, a parallel-to-serial (P/S) converter 36, a memory controller 38, and a timing control circuit 40, which are interconnected as depicted.

The S/P converter 26 has a function to convert serial input image data into parallel output image data. More specifically, the S/P converter 26 is used to receive serial R, G, and B image data 20 in response to a timing control signal 42 from the timing control circuit 40, then convert the serial data 20 into parallel data 44, and output the parallel data 44 to the data processor 28.

The data processor 28 has a function to distribute the parallel data 44 or gamma correction data 46 to the correction memories of the gamma-corrector 30. More specifically, the data processor 28 is used to sort the parallel data 44 into four kinds in response to the timing control signal 48 from the timing control circuit 40 and then output the sorted data 50, 52, 54, and 56 to the gamma-corrector 30. The data processor 28 is also used to sort the gamma correction data 46, fed through the memory controller 38, e.g. immediately after powered on, into four kinds in response to a timing control signal 48 from the timing control circuit 40, and then output the sorted data 50, 52, 54, and 56 to the gamma-corrector 30. Thus, the data processor 28 is used to classify incoming data into four pieces of data 50, 52, 54, and 56, which respectively correspond to more significant bits for R, G, and B, less significant bits for R, less significant bits for G, and lower-side bits for B.

The gamma-corrector 30 has a function to write data 50, 52, 54, and 56 fed as gamma correction data, and a lookup table function to output gamma correction data to data 50, 52, 54, and 56 fed as image data. The gamma-corrector 30 in this embodiment comprises four correction memories 58, 60, 62, and 64.

The main correction memory 58 is used to store more significant data bits for R, G, and B. The three auxiliary correction memories 60, 62, and 64 are used to store less significant data bits for R, G, and B, respectively. Read and write operations from and to the correction memories 58, 60, 62, 64 are controlled in response to a timing control signal 66 from the timing control circuit 40. That is to say, the correction memories 58, 60, 62, 64 are enabled to write gamma correction data when the timing control signal 66 is in a write enable state. The correction memories 58, 60, 62, 64 are also enabled to read out gamma correction data 68, 70, 72, and 74 corresponding to the fed data 50, 52, 54, and 56 when the timing control signal 66 is in its read enable state, and output them to the data coupler 32.

The data coupler 32 has a function to generate a piece of gamma-corrected image data from four pieces of data constituting one piece of merged data by carrying out an appropriate data coupling procedure. More specifically, the data coupler 32 is used to couple four pieces of data 68, 70, 72, and 74 constituting one piece of image data, fed in response to a coupling control signal, or timing control signal, 76 from the timing control circuit 40, into one piece of gamma-corrected image data 78, and then feed the generated data 78 to the line memory 34. For one piece of image data, R, G, and B image data are fed to one pixel. Therefore, the gamma-corrected image data is sequentially fed to the line memory 34 in the form of R, G, and B image data for each pixel.

The line memory 34 has a function to temporarily store incoming data in the amount of one horizontal line of pixels at a time. More specifically, the line memory 34 is used to store gamma-corrected image data 78 in the amount of one line at a time in response to a read/write control signal 80 from the timing control circuit 40, and then output the stored data in the amount of one line to the P/S converter 36 as gamma-corrected image 82.

The P/S converter 36 has a function to convert gamma-corrected parallel RGB image data fed in the amount of one line at a time into gamma-corrected serial RGB image data. More specifically, the P/S converter 36 is used to receive gamma-corrected parallel R, G, and B image data 82 in response to a timing control signal 84 from the timing control circuit 40, then convert the gamma-corrected parallel data 82 into gamma-corrected serial data, and output the gamma-corrected serial data to the source driver 16.

The memory controller 38 has a function to control read and write operations in a memory to be connected, and control access to the memory. The memory controller 38 is used to read out gamma correction data 18 in response to a timing control signal 86 from the timing control circuit 40, and feed the data 18 to the data processor 28 as gamma correction data 46.

The timing control circuit 40 has a function to generate signals to control timing and various operations in data processing. As set forth above, the timing control circuit 40 in this embodiment is used to feed the timing control signals 42, 48 and 66, coupling control signal 76, read/write control signal 80, and timing control signals 84 and 86 to the S/P converter 26, data processor 28, gamma-corrector 30, data coupler 32, line memory 34, P/S converter 36, and memory controller 38, respectively.

Figure 9:
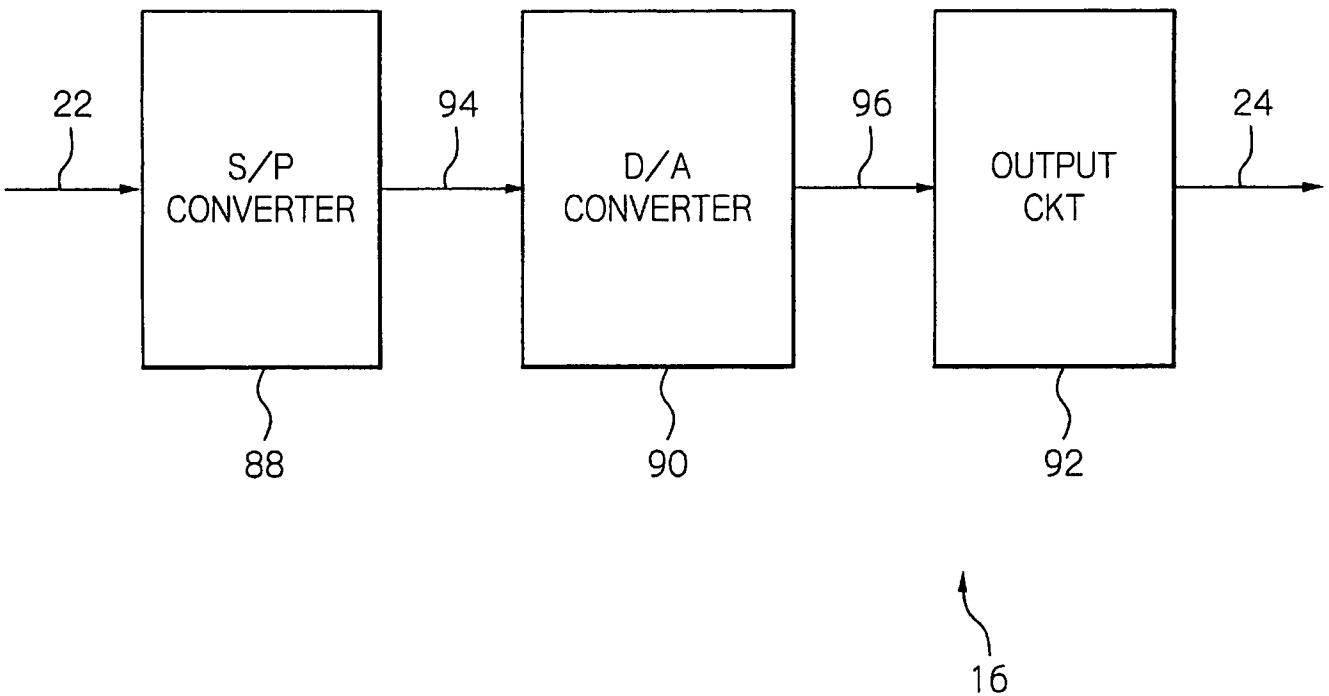
FIG. 9 is a schematic block diagram showing the source driver shown in FIG. 7.

The source driver 16, as shown in FIG. 9, includes a S/P converter 88, a D/A converter 90, and an output circuit 92. The S/P converter 88 is used to convert the gamma-corrected serial input image data 22 into gamma-corrected parallel image data 94, and output the converted image data 94 to the D/A converter 90.

The D/A converter 90 has a function to convert digital data into an analog voltage signal. More specifically, the D/A converter 90 is used to convert the gamma-corrected image data 94 into an analog voltage signal 96 and then output the converted analog voltage signal 96 to the output circuit 92.

The output circuit 92 has a function to amplify an incoming signal. The output circuit 92 is used to amplify the analog voltage signal 96 and then output the amplified analog voltage signal 24 to liquid crystal control electrodes provided in a liquid crystal display panel, not shown. This enables the liquid crystal display panel to display an image signal in accordance with the input image signal 20.

The principles of the gamma correction by the timing controller 14 will be described below. R, G, and B pixel data are different in color attribute from one another. Gamma correction data corresponding to R, G, and B are listed in Table 1. Many of the values of more significant bits in these data indicate the same value. In Table 1, image data before being corrected consists of 8 bits, while the image data after being corrected consists of 13 bits.

TABLE 1

| | After corrected (13 bit) | | |
|---|---|---|---|
| Before corrected (8 bit) | Gamma correction memory for R | Gamma correction memory for G | Gamma correction memory for B |
| 00 h | 0000 h | 0000 h | 0000 h |
| 01 h | 00D3 h | 00CB h | 00C8 h |
| 02 h | 01BD h | 0194 h | 0187 h |
| . | . | . | . |
| . | . | . | . |
| . | . | . | . |
| 7E h | 0DB4 h | 0D3F h | 0D05 h |
| 7F h | 0DC0 h | 0D4A h | 0D0F h |
| 80 h | 0DCC h | 0D54 h | 0D19 h |
| 81 h | 0DD9 h | 0D5F h | 0D23 h |
| . | . | . | . |
| . | . | . | . |

TABLE 1-continued

| Before corrected (8 bit) | After corrected (13 bit) Gamma correction memory for R | Gamma correction memory for G | Gamma correction memory for B |
|---|---|---|---|
| . | . | . | . |
| FD h | 1E69 h | 1DE1 h | 1D17 h |
| FE h | 1EDE h | 1E7D h | 1DE0 h |
| FF h | 1F62 h | 1F25 h | 1EC8 h |

Figure 1:
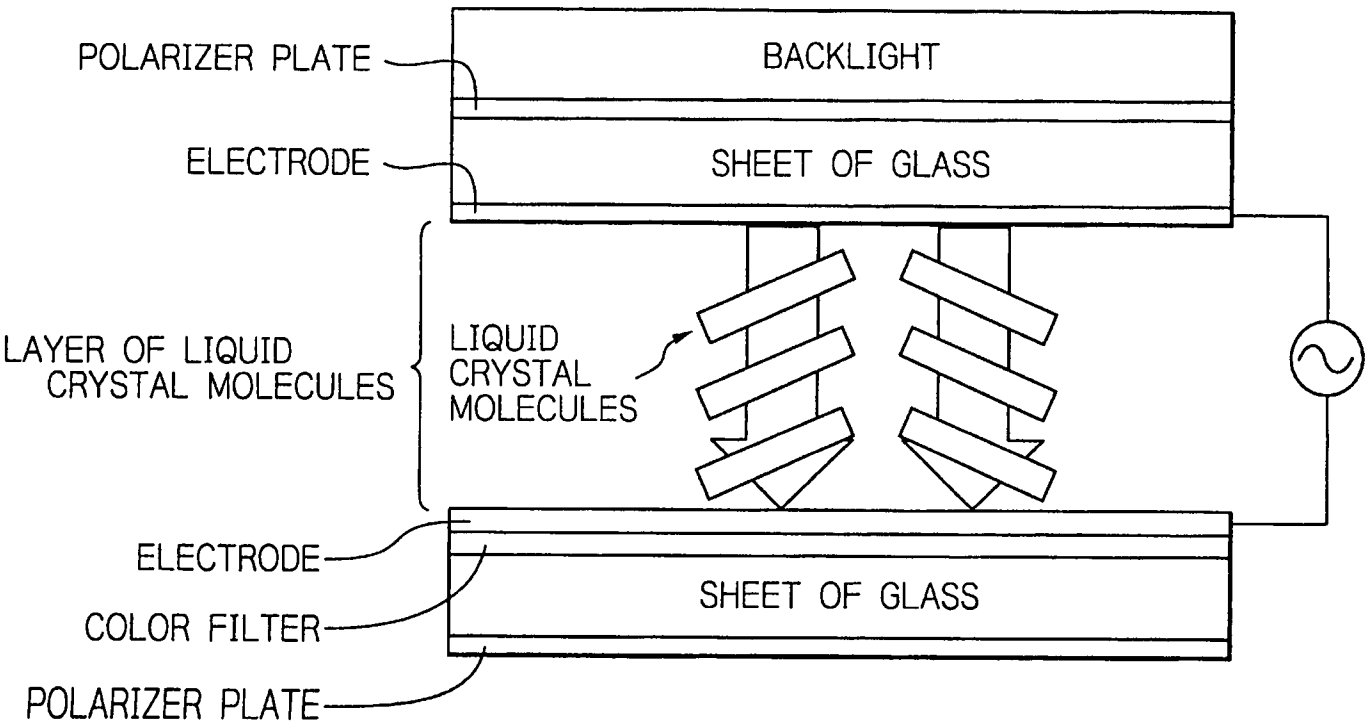
FIG. 1 is a conceptual side view useful for understanding the principle of a conventional liquid crystal display.
Figure 2:
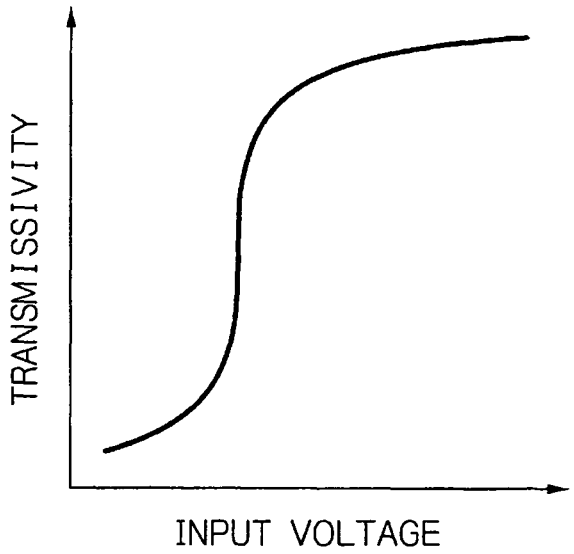
FIG. 2 shows a V-T characteristic of a liquid crystal display.
Figure 3A:
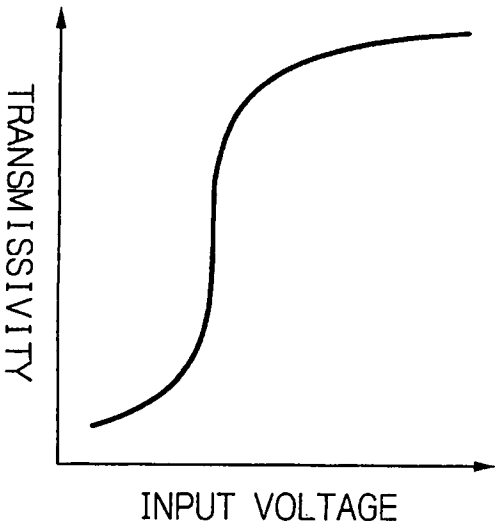
FIGS. 3A, 3B, and 3C demonstrate how the V-T characteristic varies before and after gamma correction.
Figure 3B:
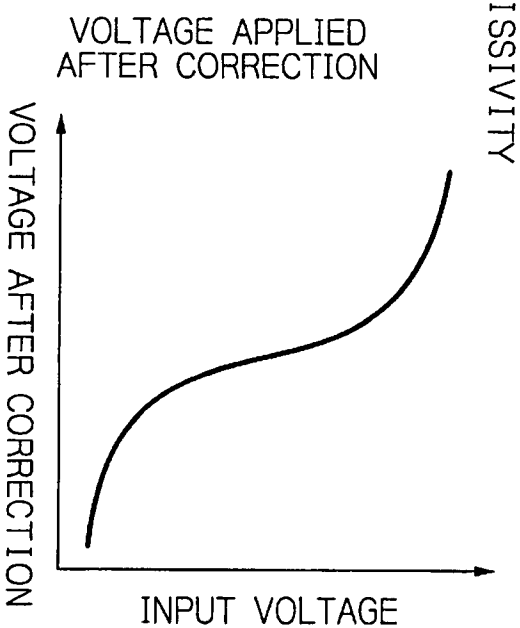
Figure 3C:
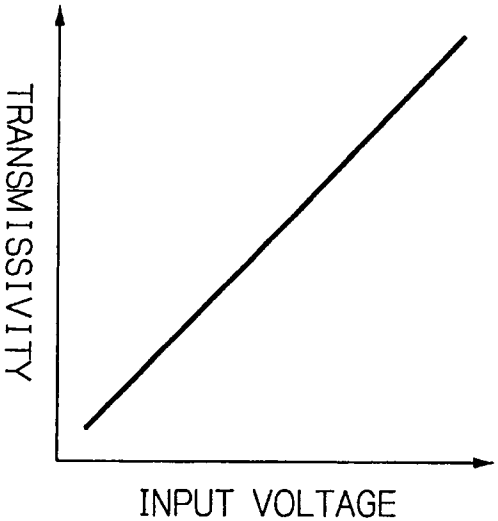
Figure 4:
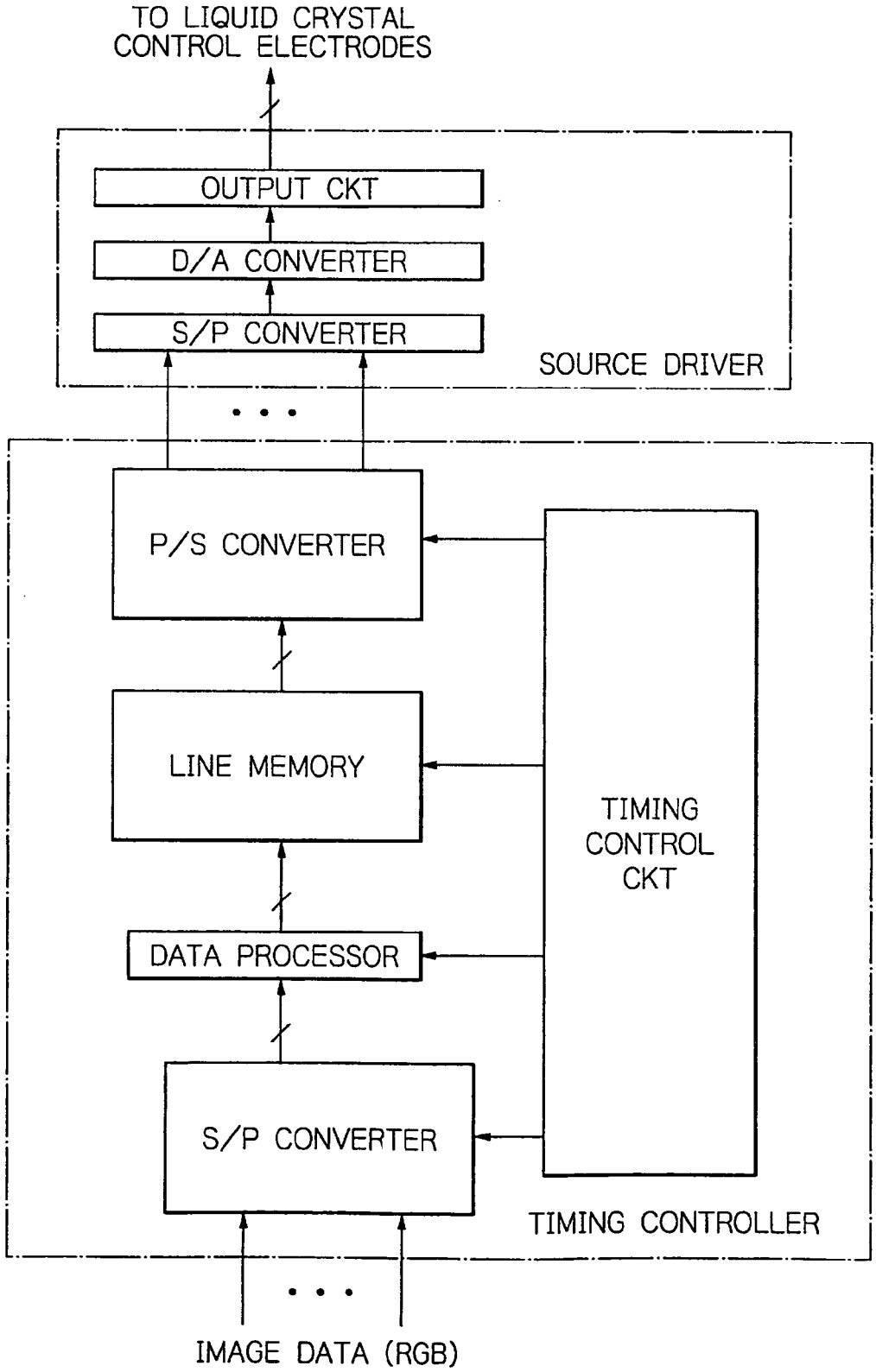
FIG. 4 PRIOR ART
FIGS. 4, 5 and 6 are schematic block diagrams showing conventional liquid crystal display controllers.
Figure 5:
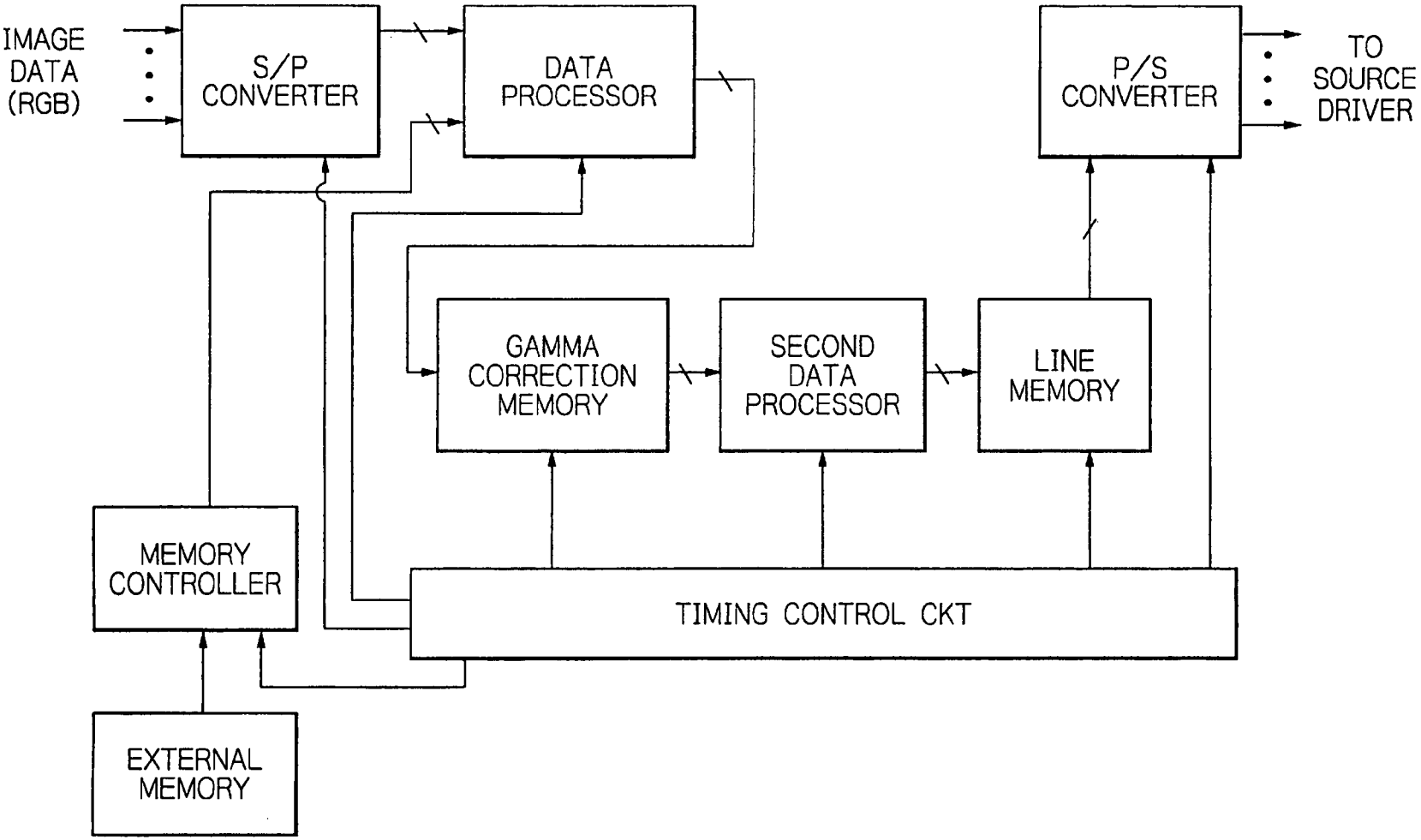
FIG. 5 PRIOR ART
Figure 6:
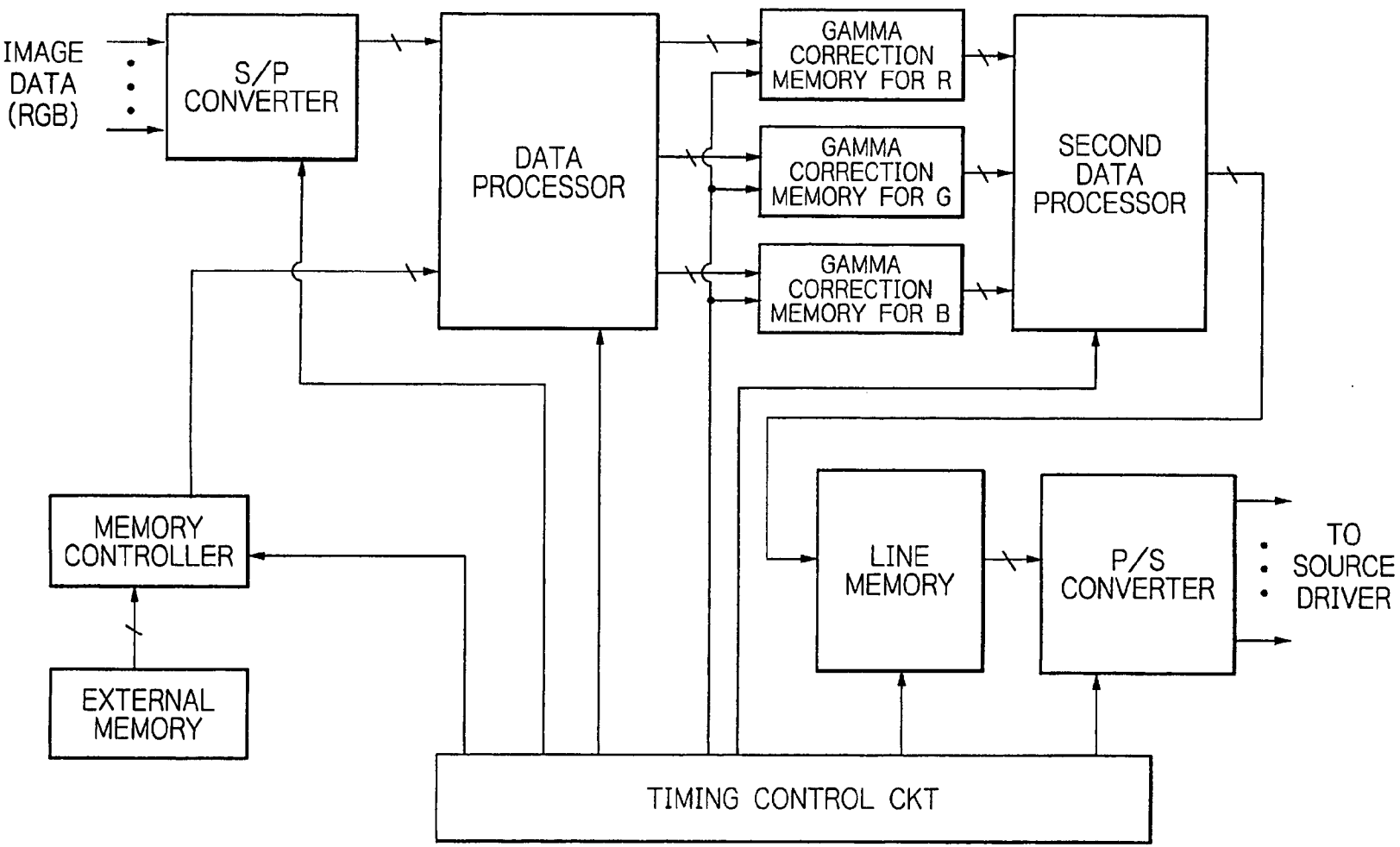
FIG. 6 PRIOR ART

Table 2 lists data structures obtained when the gamma correction data listed in Table 1 are written into the gamma correction memories of the conventional liquid crystal display controller shown in FIG. 6.

TABLE 2

| Gamma correction memory for R | | Gamma correction memory for G | | Gamma correction memory for B | |
|---|---|---|---|---|---|
| AD-DRESS | DATA | AD-DRESS | DATA | AD-DRESS | DATA |
| 00 h | 0000 h | 00 h | 0000 h | 00 h | 0000 h |
| 01 h | 00D3 h | 01 h | 00CB h | 01 h | 00C8 h |
| 02 h | 01BD h | 02 h | 0194 h | 02 h | 0187 h |
| . | . | . | . | . | . |
| . | . | . | . | . | . |
| . | . | . | . | . | . |
| 7E h | 0DB4 h | 7E h | 0D3F h | 7E h | 0D05 h |
| 7F h | 0DC0 h | 7F h | 0D4A h | 7F h | 0D0F h |
| 80 h | 0DCC h | 80 h | 0D54 h | 80 h | 0D19 h |
| 81 h | 0DD9 h | 81 h | 0D5F h | 81 h | 0D23 h |
| . | . | . | . | . | . |
| . | . | . | . | . | . |
| . | . | . | . | . | . |
| FD h | 1E69 h | FD h | 1DE1 h | FD h | 1D17 h |
| FE h | 1EDE h | FE h | 1E7D h | FE h | 1DE0 h |
| FF h | 1F62 h | FF h | 1F25 h | FF h | 1EC8 h |

Note that in the case where gamma correction data are formed as a lookup table (LUT) stored in a memory, image data before corrected serve as an address for the memory.

As clear from this, since there is no difference in more significant bits of gamma correction data between R, G, and B, the same part in each gamma correction data is corrected with the same gamma correction memory. Then, a different part in gamma correction data between component colors is corrected with its corresponding gamma correction memory. As a result, the gamma correction data for each component color can cause a memory storage capacity to reduce, compared with the case where all of data are written into the gamma correction memories for R, G, and B, as listed in Table 2.

Table 3 lists the data in gamma correction memories in the case where the gamma-corrected image data of Table 1 is divided into a common part and a different part for the gamma-corrected R, G, and B image data of 13 bits and written into those memories.

TABLE 3

| Common gamma correction memory | |
|---|---|
| ADDRESS | DATA |
| 00 h | 0 h |
| 01 h | 0 h |
| 02 h | 0 h |
| . | . |
| . | . |
| . | . |
| 7E h | 3 h |
| 7F h | 3 h |
| 80 h | 3 h |
| 81 h | 3 h |
| . | . |
| . | . |
| . | . |
| FD h | 7 h |
| FE h | 7 h |
| FF h | 7 h |

TABLE 3-continued

| Gamma correction memory for R | | Gamma correction memory for G | | Gamma correction memory for B | |
|---|---|---|---|---|---|
| AD-DRESS | DATA | AD-DRESS | DATA | AD-DRESS | DATA |
| 00 h | 000 h | 00 h | 000 h | 00 h | 000 h |
| 01 h | 0D3 h | 01 h | 0CB h | 01 h | 0C8 h |
| 02 h | 1BD h | 02 h | 194 h | 02 h | 187 h |
| . | . | . | . | . | . |
| . | . | . | . | . | . |
| . | . | . | . | . | . |
| 7E h | 1B4 h | 7E h | 13F h | 7E h | 105 h |
| 7F h | 1C0 h | 7F h | 14A h | 7F h | 10F h |
| 80 h | 1CC h | 80 h | 154 h | 80 h | 119 h |
| 81 h | 1D9 h | 81 h | 15F h | 81 h | 123 h |
| . | . | . | . | . | . |
| . | . | . | . | . | . |
| . | . | . | . | . | . |
| FD h | 269 h | FD h | 1E1 h | FD h | 117 h |
| FE h | 2DE h | FE h | 27D h | FE h | 1E0 h |
| FF h | 362 h | FF h | 325 h | FF h | 2C8 h |

As evident from Table 3, in this case, the first three bits from the leftmost bit or most significant bit are the same between R, G, and B, and therefore if thirteen data bits are divided into the first three bits from the most significant bit and ten data bits, then a lookup table (LUT) corresponding to all colors of R, G, and B can be constituted by four memories, that is, one memory having its width corresponding to 3 bits and three memories having the width thereof corresponding to 10 bits.

Thus, the number of memories in the gamma-corrector 30 increases by one in comparison with the conventional gamma-corrector including three memories each having its width corresponding to 13 bits, but the entire memory capacity can be reduced by reducing the bit width of one memory.

Upon the principles described above, any one of the four gamma correction memories 58, 60, 62, and 64 stores more significant data bits that are the same value between R, G, and B of the gamma correction data stored in the external memory 1, i.e. common data, through the data processor 28. In the preferred embodiment, the correction memory 58 stores the common data. The remaining three correction memories store reproduction data, which is obtained by removing the common data from the gamma correction data of each component color, through the data processor 28. In the preferred embodiment, the correction memories 60, 62, and 64 store the reproduction data. The correction memories 60, 62, and 64 are constituted by a lookup TABLE corresponding to R, a lookup table corresponding to G, and a lookup table corresponding to B, respectively. Obviously, the present invention is not limited to this specific combination.

Figure 10:
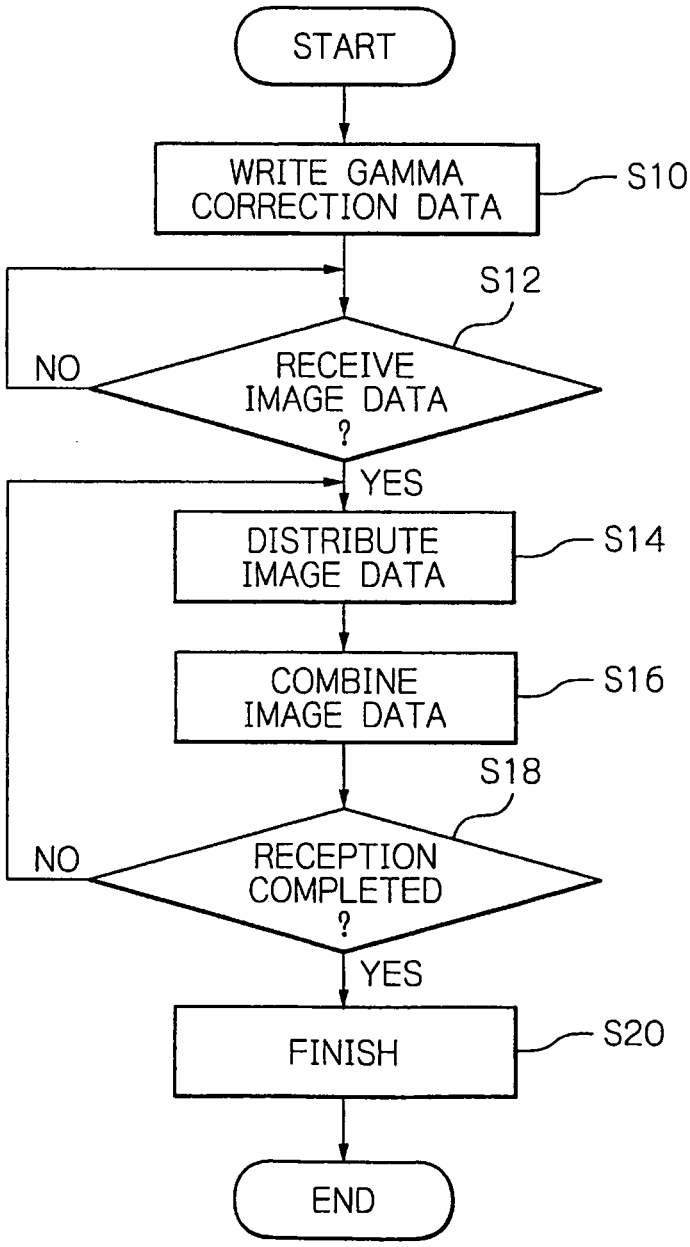
FIG. 10 is a flowchart useful for understanding how the timing controller shown in FIG. 7 performs a gamma correction on incoming image data.

Now, operation of the timing controller 14 in the preferred embodiment will be described with reference to FIG. 10. The timing controller 14 controls the memory controller 38 and data processor 28 in such a way that gamma correction data 18 is read out of the external memory 12 and distributed to the four gamma correction memories 58, 60, 62, and 64 (step S10). At this stage, the gamma-corrector 30 forms one lookup table for common data and three R, G, and B lookup tables for reproduction data.

The timing controller 14 then determines whether or not image data has been received (step S12). In the case where no image data has been received, it returns to the data reception step (to step S12). In the case where image data has been received, the timing controller 14 converts incoming image data 20 into parallel image data 44 and then feeds the converted parallel image data 44 into the data processor 28.

The timing controller 14 then distributes the parallel image 44 to the four gamma correction memories 58, 60, 62, and 64 (step S14). In the data processor 28, the image data 44 that are feed in parallel are controlled so that they are set to the addresses at R, G, and B attributes that the image data have, and are fed to the gamma correction memories 58, 60, 62, and 64 corresponding to the addresses. More specifically, pixel data with an R attribute are stored in the gamma correction memories 58 and 60, pixel data with a G attribute are stored in the gamma correction memories 58 and 62, and pixel data with a B attribute are stored in the gamma correction memories 58 and 64.

Therefore, the gamma-corrector 30, if receiving input image data with an R attribute, outputs gamma-corrected data 68, which corresponds to the more significant three data bits of the pixel data having an R attribute, from the gamma correction memory 58 to the data coupler 32, and also outputs gamma-corrected data 70 corresponding to the remaining data bits, from the gamma correction memory 60 to the data coupler 32.

Likewise, the gamma-corrector 30, if receiving input image data with a G attribute, outputs gamma-corrected data 68, which corresponds to the more significant three data bits of the pixel data having a G attribute, from the gamma correction memory 58 to the data coupler 32, and also outputs gamma-corrected data 72 corresponding to the remaining data bits, from the gamma correction memory 62 to the data coupler 32. Further, the gamma-corrector 30, if receiving input image data with a B attribute, outputs gamma-corrected data 68, which corresponds to the more significant three data bits of the pixel data having a B attribute, from the gamma correction memory 58 to the data coupler 32, and also outputs gamma-corrected data 74 corresponding to the remaining data bits, from the gamma correction memory 64 to the data coupler 32.

Next, in the data coupler 32, incoming data are coupled into a piece of gamma-corrected data (step S16). In the data coupling step, the more significant bit side and less significant bit side of incoming gamma-corrected data are coupled together for each color attribute. In the preferred embodiment, three bits on the more significant bit side is coupled with the gamma-corrected data corresponding to the remaining data bits on the less significant side, whereby the final gamma-corrected image data 78 is generated. The image data 78 is output to the line memory 34.

Now, a typical example of the data coupling step in the data coupler 32 will be described in detail. Pixel data with R, G, and B attributes are represented by a hexadecimal notation. In the case of purple data in which pixel data with an R attribute is "FD" in hexadecimal expression, pixel data with a G attribute is "00", and pixel data with a B attribute is "FD", the data coupler 32 receives the following data from the correction memories 58, 60, 62, and 64:

R: Common part of 3 bits="7" of address "FD"
Independent part of 10 bits="269" of address "FD"
G: Common part of 3 bits="3" of address "00"
Independent part of 10 bits="000" of address "00"
B: Common part of 3 bits="7" of address "FD"
Independent part of 10 bits="117" of address "FD"

As a result, the data coupler 32 couples the common part and the independent part together, thereby generating final gamma-corrected 13-bit image data 78.

R: 1E69
C: 0000
B: 1D17

The data coupler 32 generates image data 78 by the data coupling step in response to the coupling control signal 76 from the timing control circuit 40, and feeds the gamma-corrected image data 78 to the line memory 34.

The line memory 34 stores gamma-corrected image data 78 in the amount of one line at a time in response to the read/write control signal 80 from the timing control circuit 40. The gamma-corrected image data 78 in the amount of one line is output to the P/S converter 36 as RGB image data 82.

The P/S converter 36 receives gamma-corrected parallel RGB image data 82 in response to the timing control signal 84 from the timing control circuit 40, and converts the parallel RGB image data 82 into serial RGB image data 22, which is output to the source driver 16.

Next, the timing controller 14 determines whether or not reception of image data 20 has been completed (step S18). If the data reception has not been completed, the timing controller 14 returns to step S14, in which the S/P conversion step and image-data division step are repeated. If the data reception has been completed, the timing controller 14 advances to a finish step S20.

In the finish step S20, the timing controller 14 finishes the operation of the S/P converter 26, data processor 28, gamma-corrector 30, data coupler 32, line memory 34, P/S converter 36, memory controller 38, and timing control circuit 40. At the same time, the operation of the timing controller 14 ends.

The source driver 16, if receiving gamma-corrected image data 22 from the timing controller 14, converts the image data 22 into parallel image data 94 by the S/P converter 88 and then outputs the converted image data 94 to the D/A converter 90. The D/A converter 90 converts the parallel image data 94 into an analog voltage signal 96 and outputs the analog voltage signal 96 to the output circuit 92. The output circuit 92 raises the analog voltage signal 96 to such a level that can display images on the liquid crystal display panel, not shown, and then applies the raised analog voltage signal to the liquid crystal control electrodes. This makes it possible to display an image on the liquid crystal display panel in accordance with the input image data 20.

Thus, in the preferred embodiment, the timing controller 14 generates gamma correction data, which is used in performing a gamma correction on each of image data having R, G, and B attributes. The gamma correction data is generated for each of a plurality of component colors. In a plurality of pieces of image data, the common data between the plurality of component colors is stored in the gamma correction memory 58, while the reproduction data between the component colors are stored in the gamma correction memories 60, 62, and 64. By combining or coupling the common data and reproduction data together, a gamma correction is performed on image data of two or more component colors. Consequently, a storage capacity for gamma correction data can be easily reduced without complex processing.

Particularly, in the preferred embodiment, common data is the same value between the component colors in a plurality of pieces of gamma correction data, while reproduction data is data for each component color which is obtained by removing the common data from the gamma correction data of each component color.

In addition, common data is constituted by data bits which become the same value between component colors from the most significant bit in a plurality of pieces of gamma correction data. Image data corrected with common data is assumed to be on a more significant bit side, while image data corrected with reproduction data is assumed to be on a less significant bit side. Upon this assumption, by coupling more significant and less significant bits together for each component color, final gamma-corrected image data is obtained. This can achieve a reduction in a storage capacity for gamma correction data more easily.

Figure 11:
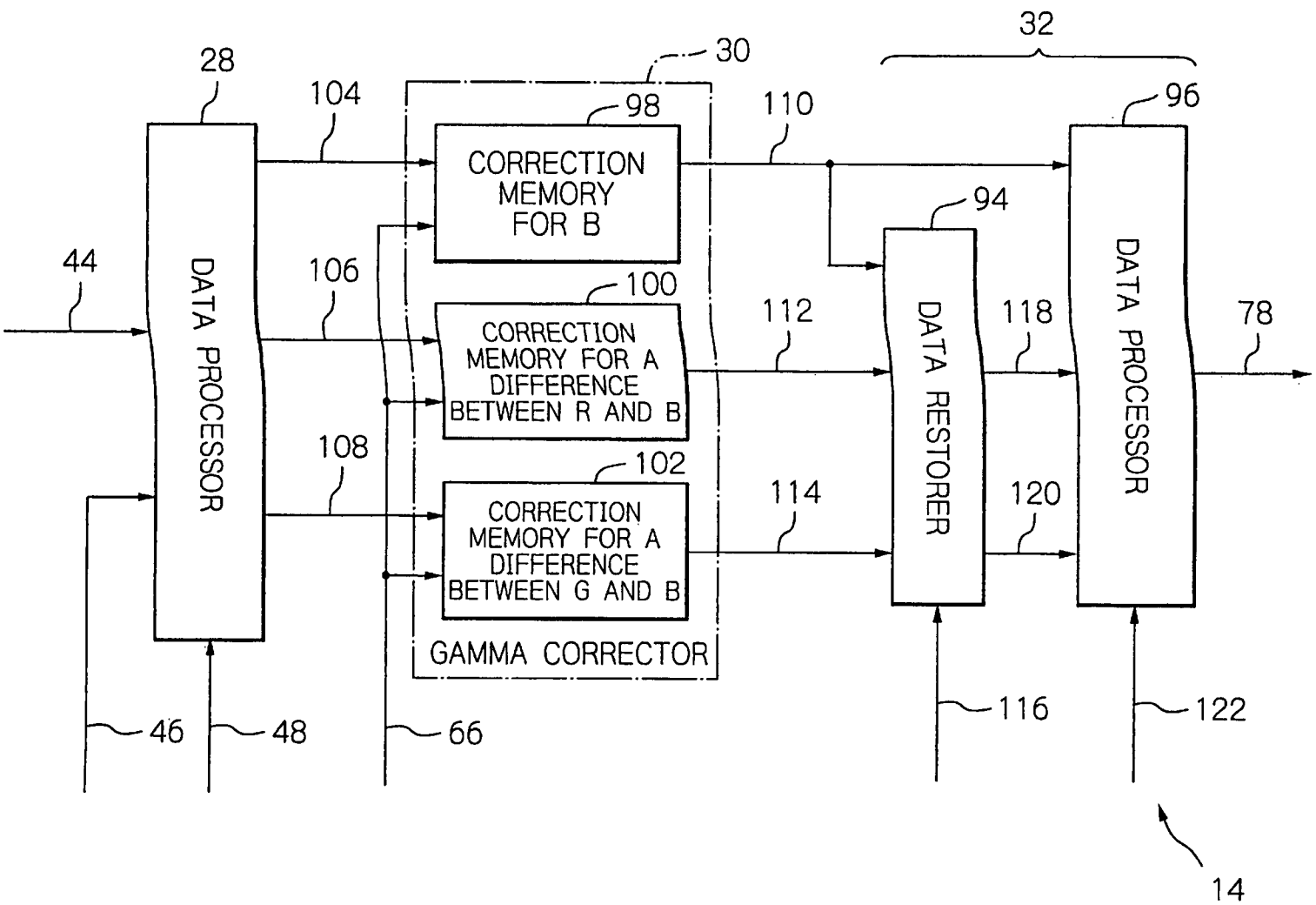
FIG. 11 is a schematic block diagram showing a timing controller included in an alternative embodiment of the liquid crystal display controller according to the present invention.

Referring now to FIG. 11, there is shown an alternative embodiment of the timing controller 14 of the liquid crystal display controller 10 to which the gamma corrector of the present invention is applied. In FIG. 11, the timing controller 14 n the liquid crystal display controller 10 is shown only in terms of its integral parts or elements. Parts or elements not shown in the figure may be the same as the preceding embodiment.

The timing controller 14 in the alternative embodiment, as shown in FIG. 11, is a data coupler 32 including a data restorer 94 and a data processor 96.

The timing controller 14 in the alternative embodiment also reduces the correction memories 58, 60, 62, and 64 of the gamma-corrector 30 to correction memories 98, 100, and 102. Thus, the number of correction memories is reduced.

A data processor 28 is the same in that it has the function of distributing image data 44 to the correction memories 98, 100, and 102 according to their color attributes, but different in method of distributing image data 44. In this method of distribution, a difference between image data of each color attribute other than a selected component color and reference gamma correction data is calculated and fed. In addition, the data processor 28 may be the same in that it has the function of distributing the gamma correction data, transferred from a main controller 38, to corresponding correction memories 98, 100, and 102, but different in that reference gamma correction data and subtractive gamma correction data are fed. More specifically, the data processor 28 is used to receive incoming image data 44 or gamma correction data 46 in response to a timing control signal 48, then divide the received data into data 104 and subtractive images 106 and 108, and feed them to the three correction memories 98, 100, and 102.

The gamma-corrector 30 is adapted to write incoming data 104, 106, and 108 into the correction memories 98, 100, and 102 in response to a timing signal 106, and read out the written data in response to the timing signal 66. The correction memory 98 stores gamma correction data for B, while the correction memories 100 and 102 store gamma correction data for R and G.

In the alternative embodiment, the gamma correction data for R denotes the subtractive data between the original gamma correction data for R and gamma correction data for B, the gamma correction data for G denotes the subtractive data between the original gamma correction data for G and gamma correction data for B.

The correction memory 98 is adapted to output gamma-corrected image data 110 to the data restorer 94 and data processor 96. The correction memories 100 and 102 are adapted to output gamma-corrected subtractive image data 112 for B and gamma-corrected subtractive image data 114 for G to the data restorer 94.

The data restorer 94 has a function to restore the original gamma-corrected image data for R and G based on the gamma-corrected subtractive image data for B and G. More specifically, the data restorer 94 is used to generate gamma-corrected image data 118 and 120 for R and G which are output based on the image data 110 and subtractive image data 112 and 114, in response to a control signal 116 fed from a timing control circuit 40. The data restorer 94 is also used to output the gamma-corrected image data 118 and 120 generated in response to the control signal 116 to the data processor 96.

The data processor 96 has a function to collect incoming gamma-corrected image data 110, 118, and 120 together as data for displaying a pixel. More specifically, the data processor 96 is used to receive gamma-corrected image data 110, 118, and 120 fed in response to a control signal 122 fed from the timing control circuit 40, then collect the gamma-corrected image signal 110, 118, and 120 together as data for displaying a pixel, and output the collected image data 78 to a line memory 34 in response to the control signal 122.

Next, the principles of the gamma correction by the liquid crystal display controller 10 of the alternative embodiment will be described. The gamma correction in the preceding embodiment can reduce a storage capacity for gamma correction memories, but since the number of memories increases, it cannot reduce an area that these memories occupy.

Hence, the alternative embodiment specifies one of the R, G, and B attributes as a selected component color. In the alternative embodiment, the selected component color is a B attribute. The gamma correction data for the selected component color is set as reference gamma correction data. The gamma correction data for color attributes other than the selected component color are represented by a difference which is obtained by subtracting reference gamma correction data. In the alternative embodiment, the color attributes other than the selected component color are R and G.

Because the alternative embodiment makes use of the above-described principles, an external memory 12 in the alternative embodiment, as listed in Table 4, has stores reference gamma correction data and subtractive image data together in advance.

TABLE 4

| Before corrected | After corrected | | |
|---|---|---|---|
| (8 bit) | R (9 bit) | G (9 bit) | B (13 bit) |
| 00 h | 000 h | 000 h | 0000 h |
| 01 h | 00B h | 003 h | 00C8 h |
| 02 h | 036 h | 00D h | 0187 h |
| . | . | . | . |
| . | . | . | . |
| . | . | . | . |
| 7E h | 0AF h | 03A h | 0D05 h |
| 7F h | 0B1 h | 03B h | 0D0F h |
| 80 h | 0B3 h | 03B h | 0D19 h |
| 81 h | 0B6 h | 03C h | 0D23 h |
| . | . | . | . |
| . | . | . | . |
| . | . | . | . |
| FD h | 152 h | 0CA h | 1D17 h |
| FE h | 0FE h | 09D h | 1DE0 h |
| FF h | 09A h | 05D h | 1EC8 h |

Further, table 5 lists the configuration data in the gamma correction memory 100, 102 and 98 on case written in reference gamma correction data and subtractive image data in according with the gamma correction data.

TABLE 5

| Gamma correction memory for R | | Gamma correction memory for G | | Gamma correction memory for B | |
|---|---|---|---|---|---|
| AD-DRESS | DATA | AD-DRESS | DATA | AD-DRESS | DATA |
| 00 h | 000 h | 00 h | 000 h | 00 h | 0000 h |
| 01 h | 00B h | 01 h | 003 h | 01 h | 00C8 h |
| 02 h | 036 h | 02 h | 00D h | 02 h | 0187 h |
| . | . | . | . | . | . |
| . | . | . | . | . | . |
| . | . | . | . | . | . |
| 7E h | 0AF h | 7E h | 03A h | 7E h | 0D05 h |
| 7F h | 0B1 h | 7F h | 03B h | 7F h | 0D0F h |
| 80 h | 0B3 h | 80 h | 03B h | 80 h | 0D19 h |
| 81 h | 0B6 h | 81 h | 03C h | 81 h | 0D23 h |
| . | . | . | . | . | . |
| . | . | . | . | . | . |
| . | . | . | . | . | . |
| FD h | 152 h | FD h | 0CA h | FD h | 1D17 h |
| FE h | 0FE h | FE h | 09D h | FE h | 1DE0 h |
| FF h | 09A h | FF h | 05D h | FF h | 1EC8 h |

As listed in Table 4, reference gamma correction data selects a B attribute as a selected component color and is represented by thirteen bits. Subtractive image data is represented by nine bits for each of R and G attributes. The gamma correction data for R and G attributes can form a lookup table by a subtractive value whose bit width is four bits smaller than that of the reference gamma correction data. Thus, the number of correction memories of the gamma-corrector 30 in the alternative embodiment is reduced compared with the number of correction memories used in the preceding embodiment Consequently, a storage capacity for correction memories can be reduced.

Next, operation of the timing controller 14 in the alternative embodiment will be described with reference to FIG. 12. The operation of the timing controller 14 is basically the same as the procedure shown in described with reference to FIG. 10. This operation differs manifestly in that the data coupling step S16 is not executed but a data restoring step S22 is executed.

To put it briefly, the data processor 28 distributes the gamma correction data 46 from the external memory 12 to the gamma-corrector 30, in which data 104 and subtractive image data 106 and 108 are written into the correction memories 98, 100, and 102 (step S10). Next, according to determination in a data reception determining step S12, the data processor 28 handles, as an address, image data that is fed at the time of reception, and then distributes it to its corresponding correction memory (step S14).

The data processor 28 inputs pixel data 104 with a B attribute to the correction memory 98, inputs subtractive pixel data 106 between pixel data with an R attribute and pixel data with a B attribute to the correction memory 100, and inputs subtractive pixel data 108 between pixel data with a G attribute and pixel data with a B attribute to the correction memory 102. The gamma-corrector 30 outputs gamma-corrected reference image data 110 to the data restorer 94 and data processor 96, and outputs gamma-corrected subtractive image data 112 and 114 to the data restorer 94.

Next, using the gamma-corrected reference image data 110 fed to the data restorer 94, a data restore process is performed on the gamma-corrected subtractive image data 112 and 114 (step S22). That is, for an R attribute, final gamma-corrected image data 118 is restored by adding the gamma-corrected reference image data 110 and the gamma-corrected subtractive image data 112 together. Similarly, for a G attribute, final gamma-corrected image data 120 is restored by adding the gamma-corrected reference image data 110 and the gamma-corrected subtractive image data 114 together. The image data 118 and 120 are output to the data processor 96.

The data process 96 collects these image data 110, 118 and 120 together and outputs the collected data to the line memory 32. Because the subsequent steps are identical with those of the preceding embodiment, a description of identical steps will not be given for avoiding redundancy.

If the timing controller 14 is constructed and operated as described above, a storage capacity for gamma correction data can be reduced without complex processing. Particularly, according to the alternative embodiment, common data is gamma correction data corresponding to an attribute of a component color selected from a plurality of component colors in a plurality of pieces of gamma correction data. Reproduction data or subtractive data is data for each color attribute other than the selected component color which is represented by a difference between the gamma correction data corresponding to a color attribute other than the selected component color and the common data. The timing controller 14 applies common data to the gamma correction of all image data having a plurality of color attributes. In the alternative embodiment, the color attribute of the common data that is applied to the gamma correction of all image data having a plurality of color attributes is a B attribute. The image data with a B attribute is output as it is. The reason for that is that the image data with a B attribute is used in generating reproduction data.

The timing controller 14 outputs gamma-corrected image data by the lookup table for each of image data having color attributes other than the selected component color, by employing the common data stored in the correction memory 98 and reproduction data stored in the correction memories 100 and 102. The timing controller 14 handles the common data as final gamma-corrected image data for the selected color (B), and obtains the final gamma-corrected image data (B+(R−B)=R, B+(G−B)=G) for the colors (R and G) other than the selected color (B) by adding the common data (B) to the reproduction data or subtractive data (R−B and G−B) for the colors (R and G) other than the selected color (B) ((B+(R−B), B+(G−B) Thus, the alternative embodiment is able to reduce a storage capacity for gamma correction data more easily.

Figure 13:
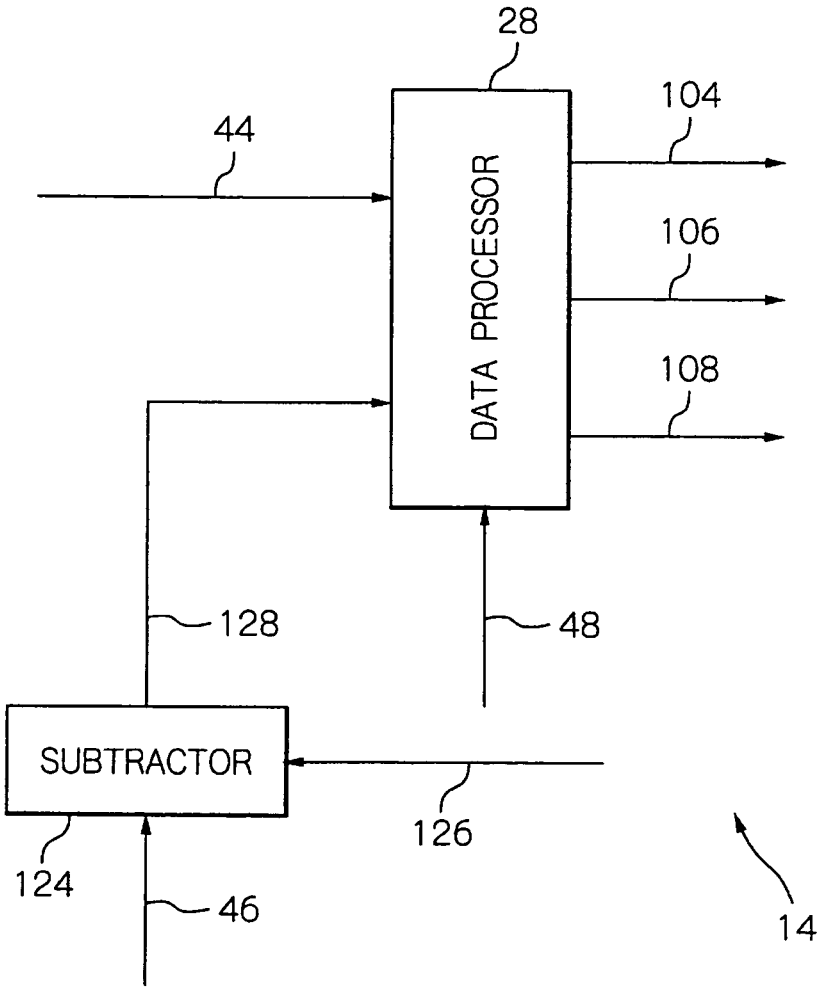
FIG. 13 is a schematic block diagram showing a timing controller included in another alternative embodiment of the liquid crystal display controller according to the present invention.

Referring now to FIG. 13, there is shown another alternative embodiment of the timing controller 14 of the liquid crystal display controller 10 to which the gamma corrector of the present invention is applied. In the other alternative embodiment, the gamma correction data stored in the external memory 12 contain no subtractive data. This embodiment employs gamma correction data corresponding to the three primary colors, R, G, and B, as listed in Table 1. The timing controller 14 further includes a subtracter 124 in addition to the constituent elements shown in FIG. 11.

The subtracter 124 functions to employ the gamma correction data 46 fed from the external memory 12 to set gamma correction data corresponding to a selected component color to reference gamma correction data, then calculate subtractive data corresponding to color attributes other than the selected component color, and output the reference gamma correction data and calculated subtractive data to the data processor 28.

More specifically, the subtracter 124 is used to receive gamma correction data 46 fed from the main controller 38 in response to a timing control signal 126 fed from the timing control circuit 40, and generate subtractive data or reproduction data for gamma correction data corresponding to color attributes other than a selected component color by subtracting reference gamma correction data from the gamma correction data. The subtracter 124 is also used to output gamma correction data 128, which contains the generated subtractive gamma correction and reference gamma correction data, to the data processor 28 in response to the timing control signal 126 from the timing control circuit 40.

Therefore, the data processor 28 may merely have the function of distributing the gamma correction data 128 fed according to color attributes.

Figure 12:
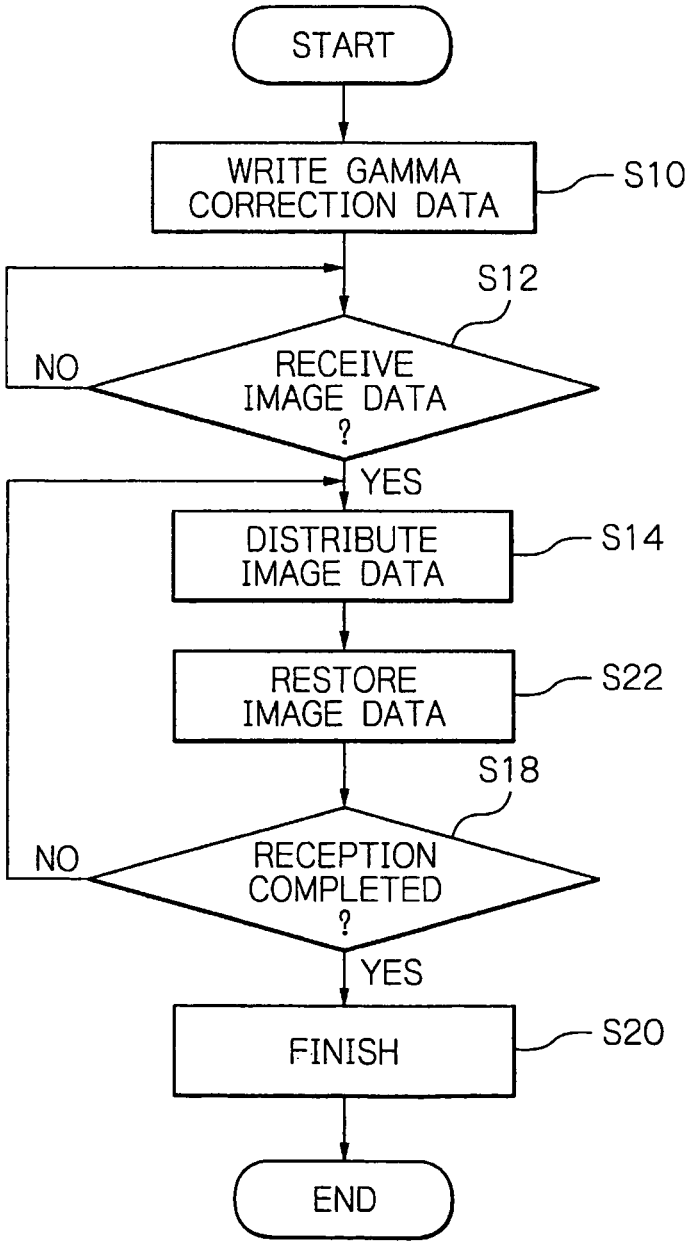
FIG. 12 is a flowchart useful for understanding how the timing controller shown in FIG. 11 performs a gamma correction on input image data.

Operation of the timing controller 14 in the other alternative embodiment may basically be the same as the procedure shown in FIG. 12. The operation in the timing controller 14 is different in that in the step of writing gamma correction data, the generation of subtractive gamma correction data processed in the data processor 28 is performed in the subtracter 124.

The timing controller 14 is thus constructed and operated as set forth above, so that the other alternative embodiment can possess the same advantages as the preceding embodiments though. Because the other alternative embodiment employs gamma correction data to calculate the aforementioned subtractive data, it is a matter of course that this embodiment can reduce a storage capacity for gamma correction data even more easily.

While the present invention has been described with reference to the particular illustrative embodiments, it is not to be restricted by the embodiments. It is to be appreciated that those skilled in the art can change or modify the embodiments without departing from the scope and spirit of the present invention.

In addition, the illustrative embodiments do not limit the present invention hereinafter claimed. Not all of the combinations given in the illustrative embodiments are indispensable to the solution according to the present invention. Because the aforementioned embodiments contain various inventive features in various stages, it is to be understood that suitable combinations of the constituent elements given herein can extract various inventive concepts. Even if some of the constituent elements disclosed herein were deleted, the remaining elements alone could be extracted as invention, insofar as they come within the scope of the appended claims.

While the preferred and alternative embodiments are applied to image data corresponding to red, green, and blue, the present invention is not to be interpreted as being limited to the three primary colors. For instance, the present invention is applicable to image data having at least one of the four primary colors (cyan, magenta, yellow, and black) in addition to the three primary colors, and image data having combinations of two or more of the seven component colors. Even in that case, the present invention can possess the same advantages as the above embodiments.

In the above embodiments, the present invention is applied to the case where a gamma correction is performed on image data which are used in displaying images on liquid crystal display panels. However, the invention is not to be limited to this case. The invention is also applicable to the case where a gamma correction is performed on image data which are used in displaying images on a cathode-ray tube (CRT) display, plasma display, or electro-luminescence display, and case where a gamma correction is performed on image data which are used in displaying images on various types of image forming or visualizing devices.

In the above, the construction of the liquid crystal display controller and processing steps executed by the timing controller have been described only by way of example. It is understood that deletion of unnecessary parts and addition of new parts in the details of the construction and processing steps may be made by those skilled in the art without departing from the scope of the invention hereinafter claimed.

Moreover, Table 1 directed to the preferred embodiment is merely an instance. Obviously the present invention may employ other values of gamma correction data.

The entire disclosure of Japanese patent application No. 2007-85135 filed on Mar. 28, 2007, including the specification, claims, accompanying drawings and abstract of the disclosure, is incorporated herein by reference in its entirety.

What is claimed is:

1. A gamma corrector for handling gamma correction data which is used in performing a gamma correction on image data represented by a plurality of component colors for each of the component colors, comprising:

a first storage for storing common data which is employed in common in predetermined gamma correction data in one-to-one correspondence to the plurality of component colors when generating final gamma-corrected image data;

a second storage for storing, for each component color, reproduction data which is represented by removing the common data from the final gamma-corrected image data of each component color in the predetermined gamma correction data;

a data processor for distributing input image data of each component color to both the first and second storages to thereby generate sorted data as address data; and a data coupler for generating the final gamma-corrected image data for image data of the plurality of component colors by employing the common data and the reproduction data according to the address data, wherein said first storage stores common data which is represented by bits of a bit region having a value common to the predetermined gamma correction data of all of the plurality of component colors, said second storage storing, for each component color, reproduction data which are represented by different bit regions obtained by removing the common bit region in predetermined gamma correction data, said data processor distributing input image data of each component color to both the bit regions of the common data and reproduction data to thereby generate address data, said data coupler coupling, for each component color, two pieces of gamma-corrected image data obtained for the common data and the reproduction data to thereby obtain the final gamma-corrected image data, wherein the common data is data in a bit region which indicates the same bits in all of the plurality of component colors from the most significant bit, in the gamma correction data of each of the plurality of component colors, said data coupler setting image data, which was gamma-corrected corresponding to the common data, to a more significant side, then sets image data, which was gamma-corrected corresponding to the reproduction data, to a less significant side image data, and obtaining the final gamma-corrected image data by coupling the image data on the more significant bit side and the image data on the less significant bit side together for each component color.

2. The gamma corrector in accordance with claim 1, wherein said first storage sets the predetermined gamma correction data of a component color selected from the plurality of component colors to common data, and stores the common data;

said second storage storing the reproduction data of each component color which is a difference between gamma correction data corresponding to each of the plurality of component colors other than the selected component color and the common data;

said data coupler including a data restorer that adds gamma-corrected image data obtained for the common data to gamma-corrected image data obtained for the reproduction data, for each component color, to thereby restore the final gamma-corrected image data.

3. The gamma corrector in accordance with claim 2, further comprising a subtracter for employing input gamma correction data of each of the plurality of component colors to calculate the reproduction data.

4. The gamma corrector in accordance with claim 1, wherein the plurality of component colors are red, green, and blue.

5. The gamma corrector in accordance with claim 1, wherein input image data is pixel data for each component color which is fed into a liquid crystal display panel.

* * * * *